United States Patent [19]

Ventura

[11] Patent Number: 4,771,927

[45] Date of Patent: Sep. 20, 1988

[54] CORDLESS PHONE HOLDER

[76] Inventor: Mario A. Ventura, 260 Aberdeen St., Dunedin, Fla. 33528

[21] Appl. No.: 934,429

[22] Filed: Nov. 24, 1986

[51] Int. Cl.[4] ..... A45F 5/02; A45C 11/00

[52] U.S. Cl. ..... 224/252; 224/901; 224/904; 224/250; 224/255; 455/90; 379/446; 379/455

[58] Field of Search ..... 224/901, 163, 182, 191, 224/250, 251, 252, 255, 253, 236, 268, 269, 904; D14/65, 59; 455/89, 90; 379/441, 449, 455, 446, 457, 61, 62; 150/52 R

[56] References Cited

U.S. PATENT DOCUMENTS

| | | | |
|---|---|---|---|
| D. 203,101 | 12/1965 | Holder | 224/252 X |
| D. 284,372 | 6/1986 | Carpenter | D14/59 |
| D. 286,636 | 11/1986 | Cooke et al. | D14/61 |
| 3,854,639 | 12/1974 | Genchi | 224/252 X |
| 3,990,617 | 11/1976 | Carter | 224/252 X |
| 4,006,764 | 2/1977 | Yamamoto et al. | 150/52 R |
| 4,046,295 | 9/1977 | Eichler | 224/251 X |
| 4,138,045 | 2/1979 | Baker | 224/236 |
| 4,228,834 | 10/1980 | Desnick | 383/117 X |
| 4,234,116 | 11/1980 | Myers | 224/250 |
| 4,358,036 | 11/1982 | Maltais | 224/252 |
| 4,420,078 | 12/1983 | Belt et al. | 224/236 X |
| 4,420,104 | 12/1983 | Di Ienno | 224/250 |
| 4,485,946 | 12/1984 | Liautaud et al. | 224/242 |
| 4,509,667 | 4/1985 | Meldrum | 224/250 |

*Primary Examiner*—Henry J. Recla
*Assistant Examiner*—Ernest G. Cusick
*Attorney, Agent, or Firm*—Dominik, Stein, Saccocio & Reese

[57] ABSTRACT

A phone holder connectable around the mid portion of a cordless remote-use type telephone handset, including an elongated flexible strap having mating releasable Velcro-type interconnecting devices at each end for retaining the strap securely in place around the handset. The phone holder also includes a support clip connected to the strap for retaining the handset to a use's waistband. The phone holder may be left in place around the handset during use, carrying, and charging in the base charging unit for the handset, enabled by the unique composition of the strap. The strap may be fabricated of a thin foraminous flexible mesh sheet or a transparent flexible sheet material which facilitates both viewing and operating the handset keys without removing the invention therefrom.

3 Claims, 1 Drawing Sheet

CORDLESS PHONE HOLDER

BACKGROUND OF THE INVENTION

The present invention relates generally to carrying devices, and more particularly to a phone holder adapted to retain a cordless telephone handset onto the waistband or belt of a user.

A variety of devices are disclosed in prior art directed to carrying articles about the waistband or belt of a user. A simple structure for retaining spectacles to the user's belt is disclosed in U.S. Pat. No. 3,148,812 to Hilsinger. A carrying device for portable articles such as small hand radios and communication devices is disclosed in U.S. Pat. No. 4,046,295 to Eichler. A clip-on carrying device for use in conjunction with portable personal radios is disclosed in U.S. Pat. No. 3,990,617 to Carter which includes unique structure to prevent the invention from being accidentally disengaged from the user's belt. A sport belt adapted to provide stereo music and the like to the user while exercising is disclosed in U.S. Pat. No. 4,569,465 to O'Farrell. Another device attachable to a belt is disclosed in U.S. Pat. No. 4,534,0635 to Krumin directed to a remote paging device and support receptacle attachable to the user's belt. A live bait carrier including a stiff contoured wire support structure connectable to the user's belt is disclosed in U.S. Pat. No. 4,174,585 to Beesley.

Because one embodiment of a unique material is disclosed in the present invention, applicant cites the following known U.S. patents directed to woven fabric structure. U.S. Pat. No. 2,712,843 to Ottinger et. al. teaches woven fabric bags having unique fabric structure. A soap bag is disclosed in U.S. Pat. No. 4,228,834 to Desnick having a strip of plastic mesh folded and stitched to form the bag. The preferred embodiment of the material therein has a hexagonal mesh structure. A carrying bag having two sheets of thermal plastic material enclosing on either side a wide mesh planar reinforcing textile structure is disclosed in U.S. Pat. No. 3,490,507 to Grashorn.

Only one device known to applicant is intended for carrying the handset of cordless telephones. That invention is disclosed in U.S. Pat. No. Des. 284,372 to Carpenter, apparently having non-transparent continous sheet material forming the walls thereof in a novel configuration.

The present invention is directed to a phone holder for the handset of cordless phones which will allow the user to carry the handset at his waist attached to his waistband or belt. Because of the unique structure of this invention, it may be releasably retained around the handset at all times, allowing the user to have full viewing function and use of the handset without its removal. The handset may, additionally be placed in its base charging unit with the invention attached thereto.

SUMMARY OF THE INVENTION

The present invention is directed to a phone holder connectable around the mid portion of a cordless remote-use type telephone handset and includes an elongated flexible strap having mating releasable Velcro-type interconnecting means at each end for retaining the strap securely in place around the handset. The phone holder also includes a support clip connected to the strap for retaining the handset to a user's waistband. The phone holder may be left in place around the handset during use, carrying, and charging in the base charging unit of the telephone, enabled by the unique composition of the strap. The strap may be fabricated of a thin foraminous flexible mesh sheet such as polyester thread vinyl coated mesh or a transparent flexible sheet material which facilitates both viewing and full functioning and use of the handset keys without removing the invention therefrom. The Velcro-type fastener allows the strap to be connected about handsets of various circumferential dimensions. The strap may be manufactured in a variety of colors with or without indicia or advertising printing thereon.

It is therefore an object of this invention to provide a phone holder for the handset of cordless telephones which facilitates the carrying of the handset at the user's waistband or belt.

It is another object of this invention to provide a phone holder for the handset of cordless telephones which may be left in place about the handset during full operation of the handset, including the viewing and operation of the keys. It is another object of this invention to provide a phone holder for the handset of cordless telephones which allows the handset to be charged within its base charging unit without removal of the invention therefrom.

It is another object of this invention to provide a phone holder for the handset of cordless telephones which is also water resistant and inexpensive to manufacture.

In accordance with these and other objects which will become apparent hereinafter, the instant invention will now be described with reference to the accompanying drawings in which:

DESCRIPTION OF THE PREFERRED EMBODIMENT

Figure 4:
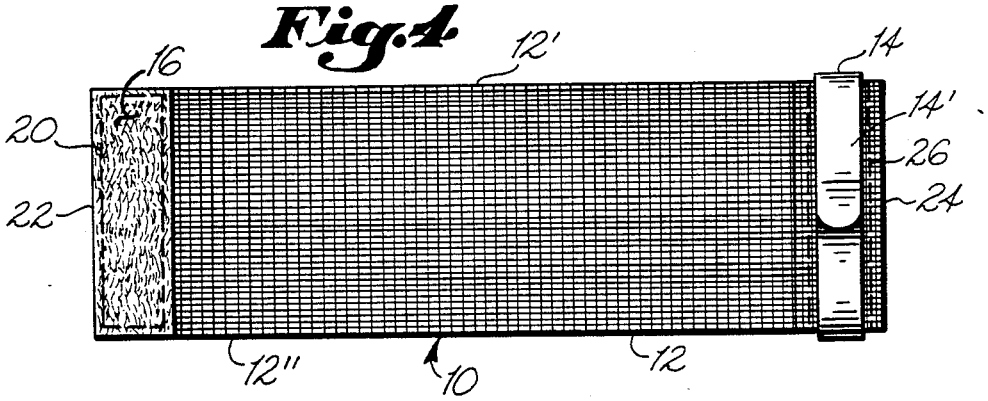
FIG. 4 is a front elevation view of the invention.
Figure 5:
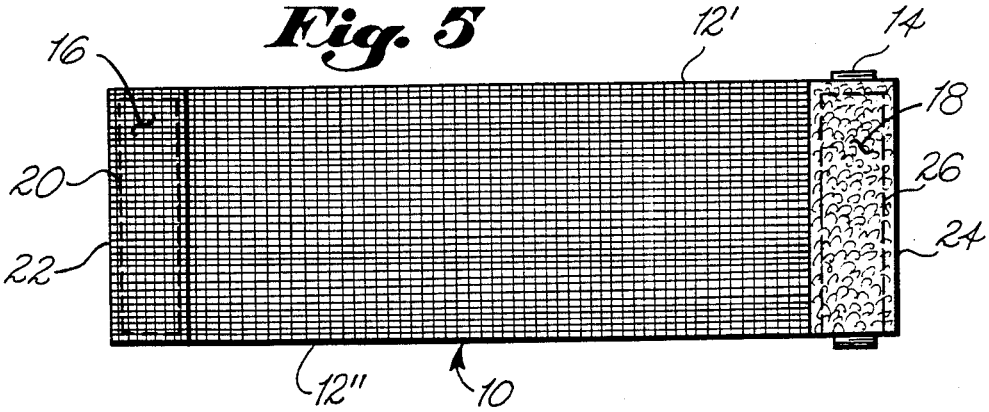
FIG. 5 is a rear elevation view of the invention.

Referring now to the drawings, the invention is shown generally at numeral 10 in its installed position around the mid portion of phone handset H. As best seen in FIGS. 4 and 5, the invention includes a length of thin sheet material forming a strap 12 having upper margin 12', lower margin 12'', left end margin 22 and right end margin 24. Disposed adjacent opposite end margins 22 and 24 and on opposite sides are strips of mating Velcro-types releasable interengaging means 16 and 18. Velcro portion 16 is stitched around its entire perimeter along 20; however, Velcro portion 18 is stitched along 26 only on its side and upper margins leaving the lower margin unstitched to receive clip 14.

Figure 2:
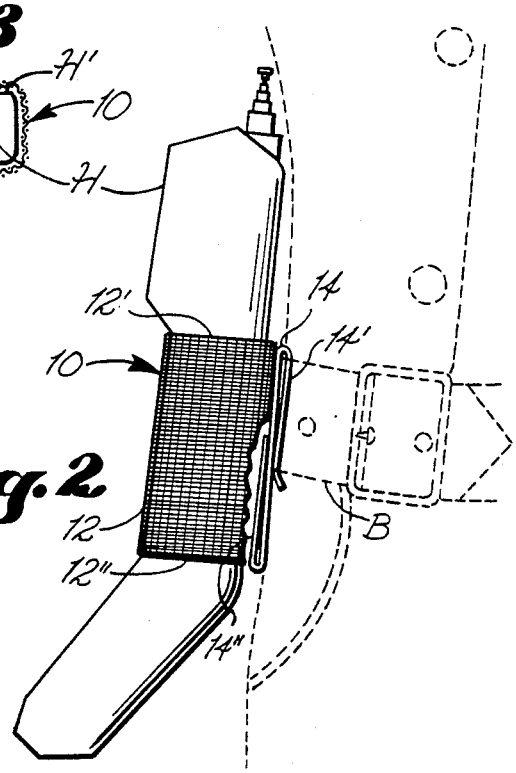
FIG. 2 is a side elevation partial broken view of FIG. 1 in the in-use position at the user's waist.

Clip 14 is formed of a strip of thin metal and formed into an S-shaped configuration and transversely disposed to the length of the strap 14 as best seen in FIG. 2. The lower portion 14'' of clip 14 is shaped to be inserted into the unstitched seam between strap 12 and Velcro portion 18 at the lower margin of each. By inserting lower clip portion 14'' between Velcro portion 18 and strap 12 such that, when the invention 10 is installed around the mid portion of the handset H, the upper portion 14′ of clip 14, interengaged around the user's belt B, will support the handset H at the user's side as best seen in FIG. 2.

Figure 1:
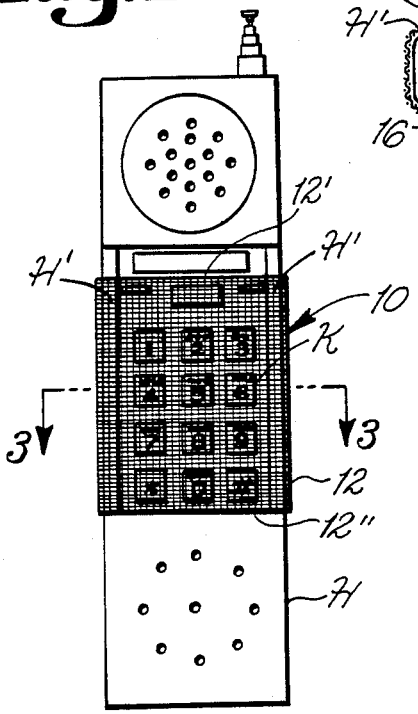
FIG. 1 is a front elevation view of a cordless phone handset with the invention installed therearound.
Figure 3:
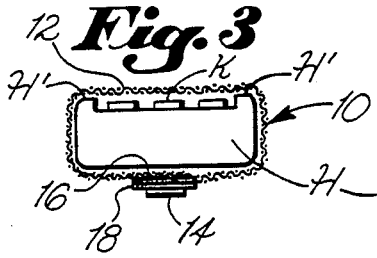
FIG. 3 is a section view in the direction of arrows 3—3 in FIG. 1.

An important aspect of the invention is best seen in FIGS. 1 and 3. The keys K of the handset H having numeral and alphabetic indicia thereon for dialing, are covered by strap 12. However, because in the preferred embodiment, the strap is made of a flexible sheet of foraminous material, the indicia on keys K is viewable therethrough as best seen in FIG. 1. Typically, the handset H includes raised side portions H′ which are at or near the height that the keys K project from the front face of handset H as best seen in FIG. 3. Although not required, where this additional structure H′ is available, strap 12 will not contact any of the keys K unless the user presses a finger or object such as a pencil over the key K to be selected. This structural feature of the handset H is not required, however, because of the even pressure applied against the keys K when the invention is installed around the handset H. In such event, the keys K will still only be depressed to make contact when the user applies pressure against the exposed surface of the desired key K.

Although the preferred embodiment of the strap 12 is of a foraminous material and is fabricated from a sheet of polyester thread vinyl coated mesh which is waterproof, it should now be well understood that the strap could be a fabricated of a sheet of transparent material or might even be a translucent material which allows sufficient viewing of the indicia on the keys for selection. The primary requirement of the material forming strap 12 is that, in addition to providing viewability of the keys, it be sufficiently flexible structurally and materially to facilitate depressing one key K at a time without causing other adjacent keys K to inadvertently also make contact.

While the instant invention has been shown and described herein in what is conceived to be the most practical and preferred embodiment, it is recognized that departures may be made therefrom within the scope of the invention, which is therefore not to be limited to the details disclosed herein, but is to be accorded the full scope of the claims so as to embrace any and all equivalent apparatus and articles.

What is claimed is:

1. In combination, a phone and a phone holder, said phone having a mid portion, said phone also having keys located at said mid portion, said phone holder comprising:

an elongated flexible sheet of thin transparent material forming a strap having opposing end margins, edge margins and surfaces; mating releasable engaging means connected to said strap for releasably retaining said phone holder in position around said mid portion of said phone; and clip means connected to said strap for supportively releasably retaining said phone and said phone holder connected therearound to a waistband of user;

said strap, when connected around said phone, structured to permit full use of said phone and viewing of said keys.

2. In combination, a phone and a phone holder, said phone having a mid portion, said phone also having keys located at said mid portion, said phone holder comprising:

an elongated flexible sheet of foraminous material forming a strap having opposing end margins, edge margins and surfaces;

mating releasable engaging means secured with respect to said strap for releasably retaining said phone holder in position around said mid portion of said phone; and clip means coupled to said strap for supportively releasably retaining said phone and said phone holder connected therearound to an article of apparel of a user;

said strap, when connected around said phone, structured to permit full use of said phone and viewing of said keys.

3. In combination, a phone and a phone holder, said phone having a mid portion, said phone also having keys located at said mid portion, said phone holder comprising:

an elongated flexible sheet of material allowing the viewing of keys therebeneath and forming a strap having opposing end margins, edge margins and surfaces;

mating releasable engaging means coupled to said strap for releasably retaining said phone holder in position around said mid portion of said phone; and clip means coupled with respect to said strap for supportively releasably retaining said phone and said phone holder connected therearound to a separate article;

said strap, when connected around said phone, structured to permit full use of said phone and viewing of said keys.

* * * * *